US009550594B1

(12) United States Patent
Snapp

(10) Patent No.: US 9,550,594 B1
(45) Date of Patent: Jan. 24, 2017

(54) GREEN WASTE BUNDLING DEVICE

(71) Applicant: Edgar Duane Snapp, Tulsa, OK (US)

(72) Inventor: Edgar Duane Snapp, Tulsa, OK (US)

( * ) Notice: Subject to any disclaimer, the term of this patent is extended or adjusted under 35 U.S.C. 154(b) by 4 days.

(21) Appl. No.: 14/835,028

(22) Filed: Aug. 25, 2015

Related U.S. Application Data

(60) Provisional application No. 62/141,527, filed on Apr. 1, 2015.

(51) Int. Cl.
*B65B 27/10* (2006.01)
*B65B 25/02* (2006.01)
*B65B 27/12* (2006.01)
*B65B 13/20* (2006.01)

(52) U.S. Cl.
CPC ..... *B65B 27/10* (2013.01); *B65B 13/20* (2013.01); *B65B 25/02* (2013.01); *B65B 27/12* (2013.01)

(58) Field of Classification Search
CPC ..... B65B 27/10; B65B 25/02; B65B 27/12; B65B 13/20; B30B 1/30; B30B 12/00
USPC ..... 100/32, 34
See application file for complete search history.

(56) References Cited

U.S. PATENT DOCUMENTS 306,729 A * 10/1884 Elder ..... B65B 27/10 100/212
342,842 A 6/1886 Randall
511,917 A 1/1894 Thomas
551,870 A * 12/1895 Miller ..... B65B 27/10 100/16
787,183 A * 4/1905 Irving ..... B65B 27/10 100/212
813,646 A 2/1906 Grill, Jr.
944,388 A * 12/1909 Stevenson ..... B65B 27/10 100/212
944,929 A * 12/1909 Westwood ..... B65B 27/083 100/219
1,005,994 A * 10/1911 Meierant ..... B65B 27/083 100/212
1,015,673 A * 1/1912 Forbes ..... B65B 27/10 100/16
2,966,111 A 12/1960 Yafjack
3,459,120 A * 8/1969 Brunette ..... B65B 27/083 100/34
3,742,842 A * 7/1973 Pierens ..... B30B 1/30 100/212
4,495,862 A 1/1985 Davis
4,572,064 A 2/1986 Burton
(Continued)

FOREIGN PATENT DOCUMENTS

DE WO 9821098 A1 * 5/1998 ..... B65B 27/10
FR 433888 A * 1/1912 ..... B65B 27/10
FR 2582574 A1 * 12/1986 ..... B65B 27/10

*Primary Examiner* — Jimmy T Nguyen
(74) *Attorney, Agent, or Firm* — Head, Johnson & Kachigian, P.C.

(57) ABSTRACT

A green waste bundling device is configured to compactly bundle tree branches, tree limbs, and other yard debris. The bundling device has a frame and a bundling assembly attached to the frame. The frame includes a generally U-shaped interior portion configured for receipt of yard debris. The bundling assembly includes a winch and a strap, with the strap configured to span the interior portion of the frame. The strap has a retainer element removably securable to a securing eye on the frame. The winch may be manually operated using a handle or electrically operated using a remote control.

13 Claims, 2 Drawing Sheets

(56) References Cited

U.S. PATENT DOCUMENTS

| | | | | | |
|---|---|---|---|---|---|
| 4,714,016 | A * | 12/1987 | Bond | B65B 27/10 | 100/212 |
| 4,829,750 | A * | 5/1989 | Cassidy | B65B 27/10 | 53/390 |
| 4,926,748 | A * | 5/1990 | Smith | B65B 67/00 | 100/34 |
| 4,939,989 | A | 7/1990 | Zacharias | | |
| 5,042,371 | A | 8/1991 | Katz | | |
| 5,289,765 | A * | 3/1994 | Gray | B65B 27/10 | 100/212 |
| 5,819,642 | A * | 10/1998 | Stuchl | B65B 27/10 | 100/212 |
| 6,014,927 | A * | 1/2000 | Hilford | A01F 15/00 | 100/212 |
| 8,495,955 | B1 * | 7/2013 | Zimmer | B65B 27/10 | 100/3 |
| 2004/0211327 | A1 * | 10/2004 | Bock | A01F 1/02 | 100/8 |

* cited by examiner

GREEN WASTE BUNDLING DEVICE

CROSS REFERENCE TO RELATED APPLICATIONS

This application claims priority to and the benefit of U.S. Provisional Patent Application Ser. No. 62/141,527, entitled Green Waste Binder, filed Apr. 1, 2015, which is incorporated herein by referenced in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention relates generally to a green waste bundling device that binds limbs, shrubs, and other green waste together tightly. The brush bundling and bailing device bundles green waste in a more compact form, allowing more debris to be placed in proper disposal areas.

2. Description of the Related Art

When trimming trees, shrubs, and other yard items, people typically end up with a number of limbs and debris littered on the ground. Individuals can try to bind the limbs together for transport, only to be left unsuccessful due to the bundles being too large and heavy to transport. Homeowners must then pay others to dispose of green waste. This entire process can be incredibly frustrating, expensive, and time consuming. Therefore, there exists a need for a device that facilitates the bundling of yard debris.

It is therefore desirable to provide users with a device capable of binding limbs, shrubs, and other yard debris into a compact configuration, offering ease and convenience when disposing of green waste.

It is further desirable to provide a green waste bundling device that may be manual or remotely controlled, ensuring bundles of green waste are tightly wound together.

It is still further desirable to provide a green waste bundling device that prevents limbs, shrubs, and debris from falling out of place in bundles and creating an additional mess.

It is yet further desirable to provide a green waste bundling device that eliminates the need to make trips or paying an individual to take green waste to a disposal site or landfill.

It is still yet further desirable to provide a green waste bundling device that saves extensive amounts of time, effort, and money when disposing of limbs, shrubs, and other items.

Other advantages and features will be apparent from the following description, and from the claims.

SUMMARY OF THE INVENTION

In general, in a first aspect, the invention relates to a green waste bundling device having a frame and a bundling assembly attached to the frame. The frame includes a generally U-shaped interior portion configured for receipt of yard debris. The bundling assembly includes a winch and a strap, with the strap configured to span the interior portion of the frame. The strap has a retainer element removably securable to a securing eye on the frame.

The frame of the bundling device may include a first generally upright side frame having a first securing eye and a second generally upright side frame opposing the first side frame. The second frame also has a securing eye, and a base is attached intermediate of the first side frame and the second side frame. The first side frame and the second side frame may each respectively have generally U-shaped leg bar members. In addition, the base may be generally perpendicular to the first side frame and the second side frame forming the interior portion.

In general, in a second aspect, the invention relates to a green waste bundling device having a frame, along with a bundling assembly and a fastener retainer respectively attached to the frame. The frame may include a first generally upright side frame, a second generally upright side frame opposing the first side frame, an intermediate base attached generally perpendicular to the first side frame and the second side frame, and a generally U-shaped interior portion configured for receipt of yard debris. The first side frame and the second side frame may each respectively have generally U-shaped leg bar members. The interior portion is between the first side frame and second side frame and above the intermediate base. The first side frame has a first securing eye, and the second side frame has a second securing eye. The bundling assembly has a winch and a strap, with the strap configured to span the interior portion of the frame. The strap includes a retainer element on a terminal end, and the retainer element is removably securable to the first securing eye or the second securing eye on the frame.

In accordance with the first or the second aspect of the invention, the frame of the bundling device may be constructed of steel or aluminum, and at least one wheel can be rotatably connected to the frame. The winch may include a handle or an electrically controlled remote. Moreover, the fastener retainer may be a platform and/or an annular holder element.

DETAILED DESCRIPTION OF THE INVENTION

Figure 1:
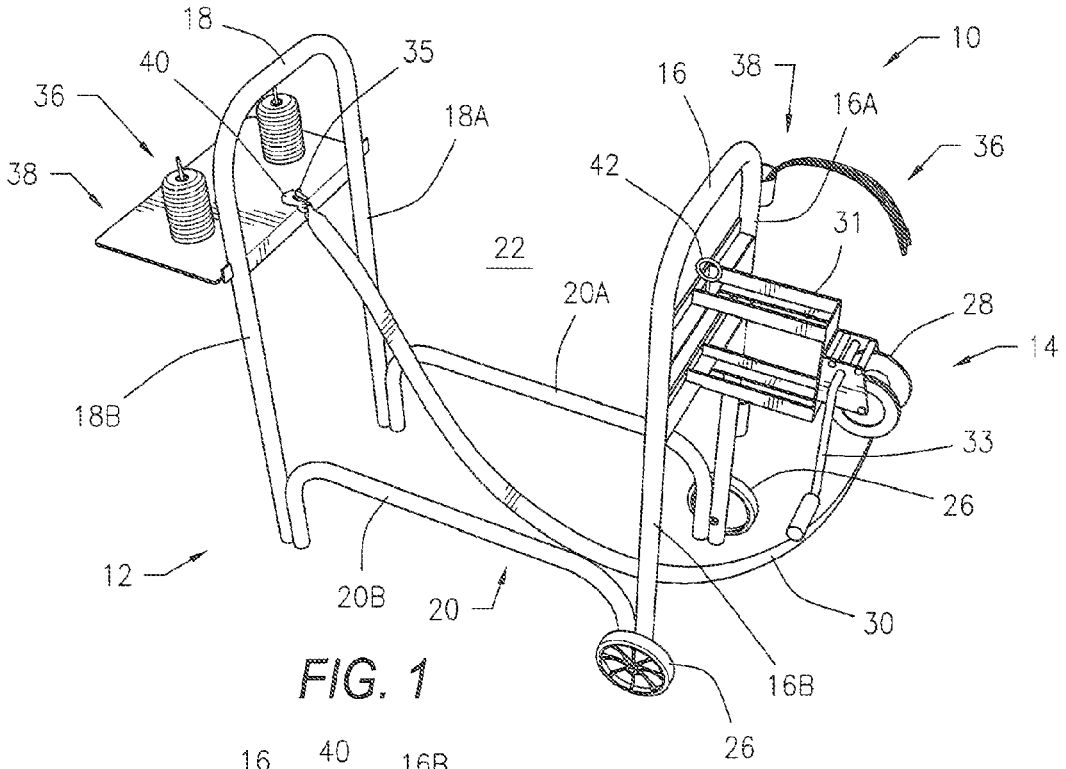
FIG. 1 is a perspective view of an example of a manually-controlled green waste bundling device in accordance with an illustrative embodiment of the invention disclosed herein.

The device and methods discussed herein are merely illustrative of specific manners in which to make and use this invention and are not to be interpreted as limiting in scope.

While the invention has been described with a certain degree of particularity, it is to be noted that many modifications may be made in the details of the construction and the arrangement of the elements and components of the devices and/or in the sequences and steps of the methods without departing from the scope of this disclosure. It is understood that the devices and methods are not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "above," "below," "up," "down," "top" and "bottom" as well as derivatives thereof (e.g., "horizontally," "downwardly," "upwardly" etc.) should be construed to refer to the orientation as then described or as shown in the drawings under discussion. These relative terms are for convenience of description and do not require that the machine be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece, such as by welding, binding with adhesives, riveting, threaded fasteners, or bending in the form of a crimped seam. Structural steel and sheet metal are the usual starting materials for fabrication, and welding wire, flux, and fasteners may join the fabricated pieces. Further, the fabricated pieces may be finished, such as with paint, powder coat, chrome or nickel plating.

Figure 2:
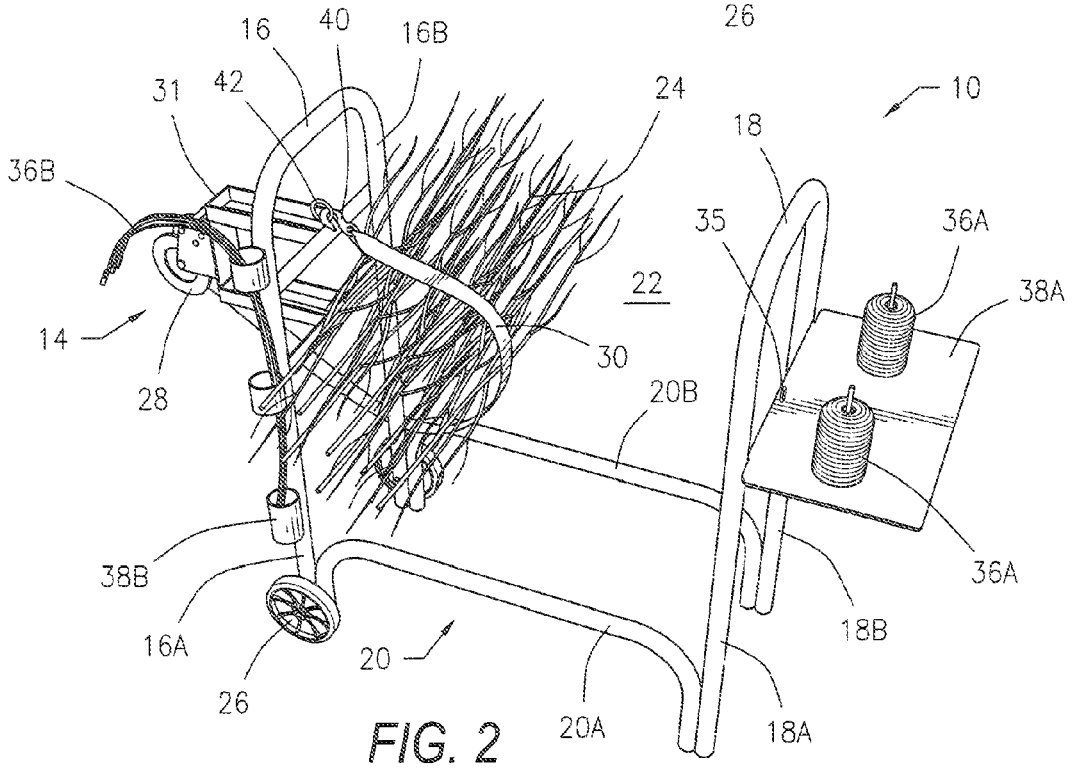
FIG. 2 is a perspective view of the exemplary green waste bundling device of FIG. 1 shown in use.
Figure 3:
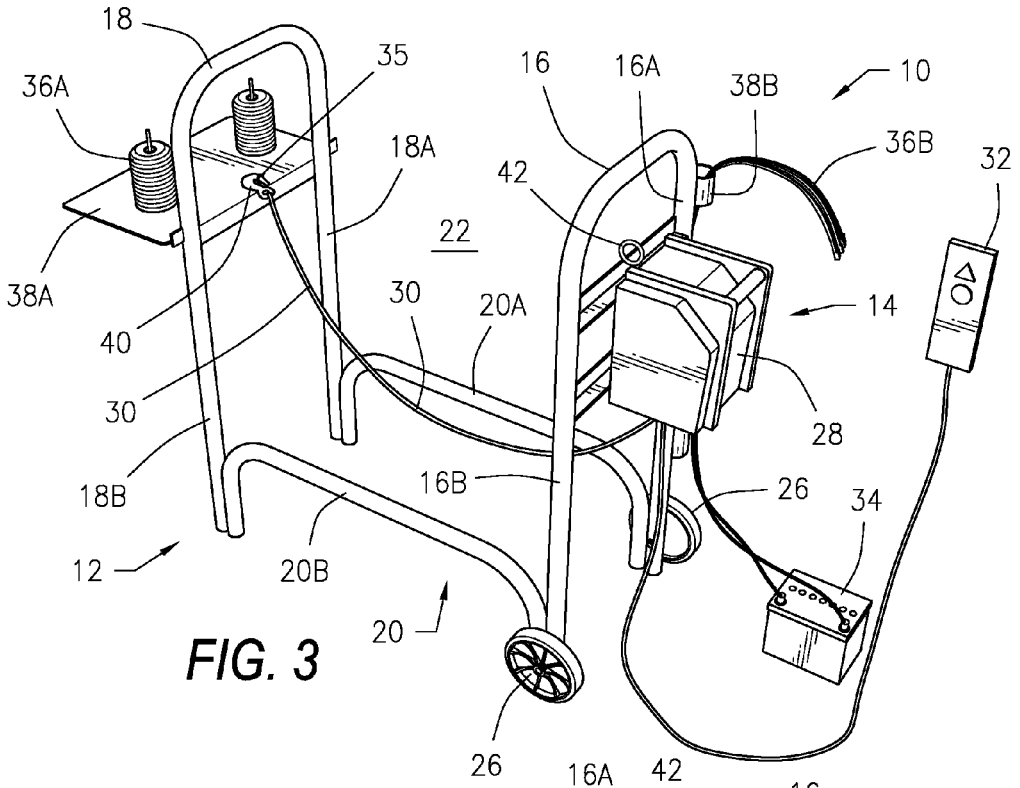
FIG. 3 is a perspective view of an example of a remotely-controlled green waste bundling device in accordance with an illustrative embodiment of the invention disclosed herein.
Figure 4:
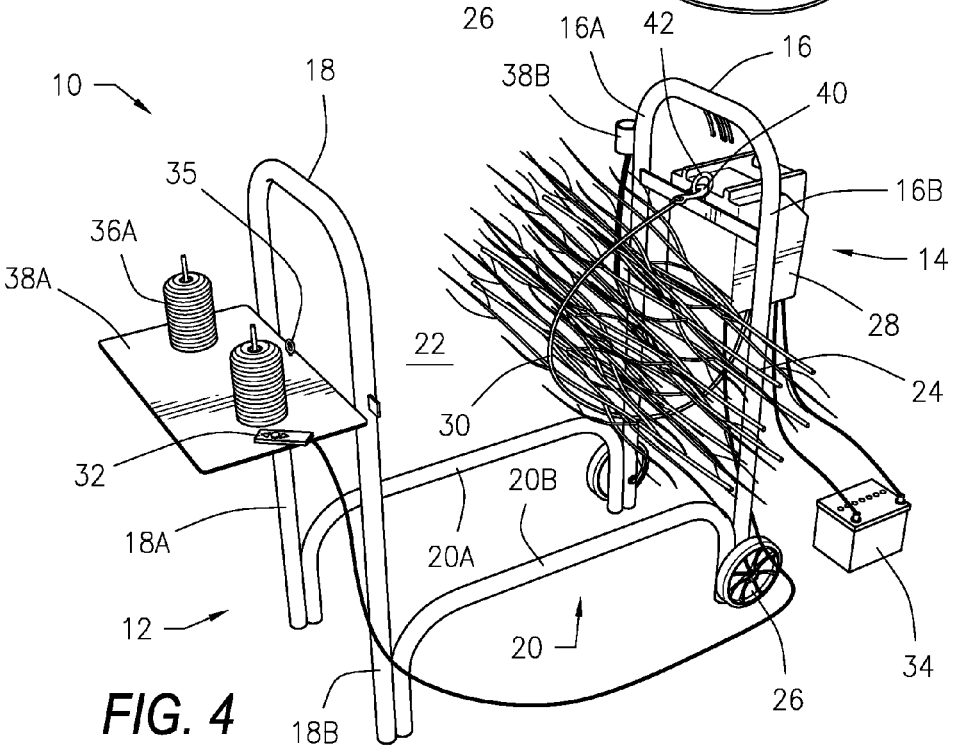
FIG. 4 is a perspective view of the exemplary green waste bundling device of FIG. 3 shown in use.

Referring to the figures of the drawings, wherein like numerals of reference designate like elements throughout the several views, a green waste bundling device 10 that is configured to compactly bundle tree branches, limbs, and other yard debris. The bundling device 10 includes a frame 12 and a bundling assembly 14. The frame 12 may include a first generally upright side frame 16 and a second generally upright side frame 18 opposing the first side frame 16. Both the first side frame 16 and the second side frame 18 are attached to an intermediate base 20 of the frame 12. As illustrated throughout the drawings, the first side frame 16 and the second side frame 20 may be generally U-shaped having leg bar members 16A, 16B, 18A and 18B, respectively. Similarly, the base 20 may be constructed using crossbar members 20A and 20B. Based on this configuration, the base 20 is generally perpendicular to the first side frame 16 and the second side frame 18, thereby forming a generally U-shaped interior portion 22 for receipt of the yard debris 24. The frame 12 may be constructed from steel, as illustrated from structural steel tubing, aluminum or other structurally resilient material. The first side frame 16, the second side frame 18 and/or the base 20 of the frame 12 may include outer walls (not shown), which may be constructed from sheet metal or other resilient material. In addition, the frame 12 may include wheels 26 rotatably secured thereto, such as to leg bar members 16A and 16B, in order to enable maneuverability of the bundling device 10 either while empty, as illustrated in FIGS. 1 and 3, or when loaded with yard debris as illustrated in FIGS. 2 and 4.

The bundling assembly 14 is attached to the frame 12 of the bundling device 10, and includes a winch 28 and a strap 30. As illustrated the winch 28 is attached to the first side frame 14 using a mounting bracket 31, and the strap 30 spans the interior portion 22 of the bundling device 10. A retainer element 40, such as a hook, on a terminal end of the strap 30 is removably securable to a securing eye 35 on the second side frame 18 of the bundling device 10. As illustrated in FIGS. 1 and 2, the winch 28 of the bundling assembly 14 is manually driven by a user using a handle 33, whereas as illustrated in FIGS. 3 and 4, the winch 28 is electrically connected to a remote 32 and a power source 34, which allows for the winch 28 to be electrically operated by the user. The bundling assembly 14 may also include one or more fasteners 36, which may be retained in a fastener retainer 38 attached to the bundling device 10 offering easy access to the user when needed, such as using a platform 38A and/or an annular holder element 38B attached to the frame 12. The fasteners 36, which may include twine 36A, tie fasteners 36B or the like, are configured to tie up the yard debris 24 in a bundle-like fashion.

Tree branches, tree limbs, and other yard debris 24 are placed horizontally in the interior portion 22 on the base 20 of the frame 12. The user can then secure the retainer element 40 on the terminal end of the strap 30 to a securing eye 42 on the first side frame 16 such that the strap 30 encircles the yard debris 24 positioned with the interior portion 22 of the bundling device 10. When the winch 28 is actuated, either manually as exemplified in FIG. 2 or remotely as exemplified in FIG. 4, the strap 30 of the bundling assembly 14 provides tension to the yard debris 24 forming a compact bundle of tree branches, tree limbs, and other yard debris 24. The user can then use the fasteners 36 to tie up the compact bundle of yard debris 24 into a tight, neat bundle so that the bundle of yard debris 24 can be conveniently transported by one individual.

The bundling device 10 is intended to tightly bind yard debris 24 and ensure the measurements of the yard debris 24 do not exceed predetermined dimensions, such as two (2) feet in length, two (2) feet in width, and four (4) feet in height. One having ordinary skill in the art, however, will appreciate that the bundling device 10 may be constructed in different sizes in order to accommodate the needs and preferences of all users, and that exact size, measurement, construction, and design specifications may vary upon manufacturing. Further, the weight of the bundled yard debris 24 is intended to not exceed 40-60 lbs.

Whereas, the invention has been described in relation to the drawings and claims, it should be understood that other and further modifications and formulations, apart from those shown or suggested herein, may be made within the scope of this invention.

What is claimed is:

1. A green waste bundling device, comprising:

a frame comprising a generally U-shaped interior portion configured for receipt of yard debris, said frame further comprising:

a first generally upright side frame having a first securing eye;

a second generally upright side frame opposing said first side frame, said second frame having a second securing eye; and a base attached intermediate of said first side frame and said second side frame; wherein said base is generally perpendicular to said first side frame and said second side frame forming said interior portion;

a fastener retainer platform attached to said first generally upright side frame of said frame of said bundling device, said fastener retainer platform includes a fastener retainer for retaining at least one fastener; and a bundling assembly attached to said second generally upright side frame of said frame, said bundling assembly comprising a winch and a strap, said strap configured to span said interior portion of said frame, said strap comprising a retainer element removably securable to said first securing eye or said second securing eye on said frame, wherein the strap provides tension to the green waste when the winch is actuated to form a compact bundle of green waste, and a user can then use the fastener to tie up the compact bundle of green waste.

2. The bundling device of claim 1 further comprising said first side frame and said second side frame each respectively having generally U-shaped leg bar members.

3. The bundling device of claim 1 wherein said frame is constructed of steel or aluminum.

4. The bundling device of claim 1 further comprising at least one wheel rotatably connected to said frame.

5. The bundling device of claim 1 wherein said winch includes a handle or an electrically controlled remote.

6. The bundling device of claim 1 wherein said bundling assembly further comprises at least one fastener removably retained by a second fastener retainer.

7. The bundling device of claim 6 wherein said fastener is twine and/or tie fasteners.

8. The bundling device of claim 6 wherein said second fastener retainer further comprises an annular holder element attached to said second generally upright side of said frame of said bundling device.

9. A green waste bundling device, comprising:

a frame comprising:

a first generally upright side frame having a first securing eye;

a second generally upright side frame opposing said first side frame, said second side frame having a second securing eye; and an intermediate base attached generally perpendicular to said first side frame and said second side frame; and a generally U-shaped interior portion configured for receipt of yard debris, said interior portion being between said first side frame and second side frame and above said intermediate base;

a bundling assembly attached to said second generally upright side frame with a mounting bracket, said bundling assembly comprising a winch and a strap, said winch comprising a manually operated winch or an electrically controlled winch, said strap configured to span said interior portion of said frame, said strap comprising a retainer element on a terminal end, said retainer element removably securable to said first securing eye or said second securing eye on said frame;

at least one wheel rotatably connected to said frame; and a plurality of fastener retainers attached to said frame and configured to retain fasteners, one of said fastener retainers comprising a platform and another one of said retainers comprising an annular holder element, wherein the strap provides tension to the green waste when the winch is actuated to form a compact bundle of green waste, and a user can then use the fastener to tie up the compact bundle of green waste.

10. The bundling device of claim 9 further comprising said first side frame and said second side frame each respectively having generally U-shaped leg bar members.

11. The bundling device of claim 9 wherein said frame is constructed of steel or aluminum.

12. The bundling device of claim 9 wherein said winch includes a handle or an electrically controlled remote.

13. The bundling device of claim 9 wherein said fastener is twine and/or tie fasteners.

* * * * *